United States Patent [19]

Martin

[11] Patent Number: 4,690,209

[45] Date of Patent: Sep. 1, 1987

[54] AIR CONDITIONER EVAPORATOR SYSTEM

[76] Inventor: Cory I. Martin, 401 Second Ave., P.O. Box 26087, Dallas, Tex. 75226

[21] Appl. No.: 712,622

[22] Filed: Mar. 18, 1985

[51] Int. Cl.[4] ..... F28D 1/00

[52] U.S. Cl. ..... 165/150; 165/135; 165/149; 165/151; 62/515

[58] Field of Search ..... 165/144, 145, 69, 149, 165/135, 136, 150, 151; 62/458, 515

[56] References Cited

U.S. PATENT DOCUMENTS

| | | | |
|---|---|---|---|
| 2,054,404 | 9/1936 | Askin | 165/151 X |
| 2,669,099 | 2/1954 | Malkoff | 165/144 X |
| 2,782,454 | 2/1957 | Slaasted et al. | 164/144 |
| 3,610,324 | 10/1971 | Davidson et al. | 165/69 |
| 4,483,392 | 11/1984 | Korsmo et al. | 165/151 X |

FOREIGN PATENT DOCUMENTS

| | | | |
|---|---|---|---|
| 164308 | 9/1933 | Switzerland | 62/515 |

*Primary Examiner*—Stephen F. Husar
*Attorney, Agent, or Firm*—T. D. Copeland

[57] ABSTRACT

An air conditioner evaporator system that is interchangeable with existing automotive systems, and yet has substantial other uses, that employs an expandable liquid/gas media, such as freon, that is injected into a unique staggered coil arrangement, whereby the expanding gas travels through limited predetermined cycles only, before returning to the compressor for condensation and recycling; and wherein the exposed ends of the coils are insulated in a very facile way to preserve the refrigerating capability of the freon gas within the interior of the coils and simultaneously prevent sweating (condensation) on the exterior surface of the coils.

6 Claims, 16 Drawing Figures

FIG. 1 AFTER-MARKET PRIOR ART
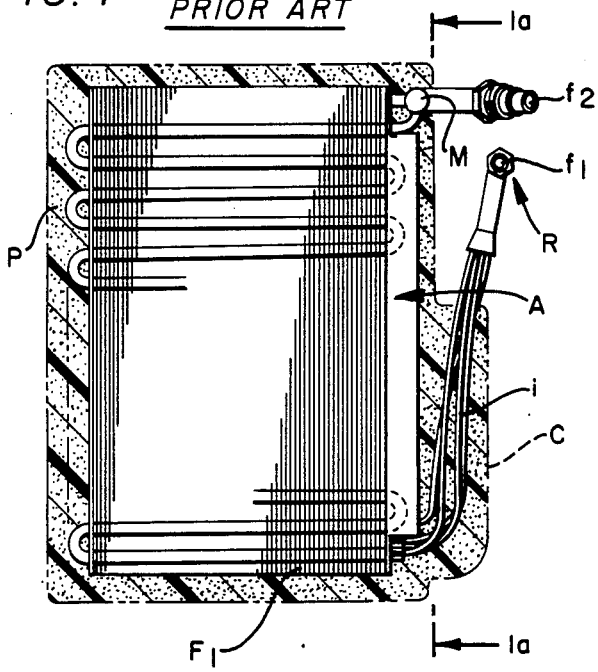
FIG. 1a
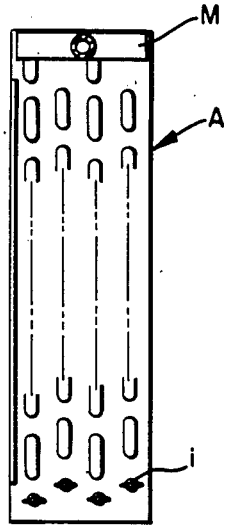
FIG. 2 "O.E.M." PRIOR ART
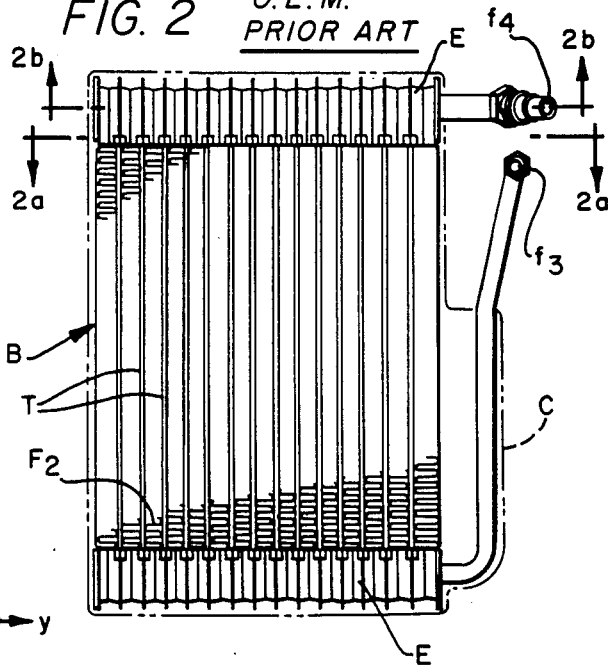
FIG. 2a
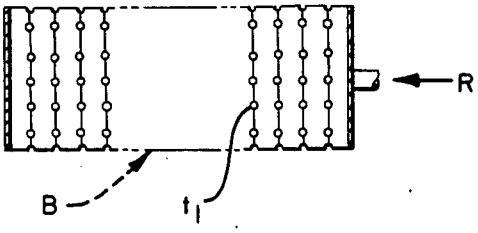
FIG. 3
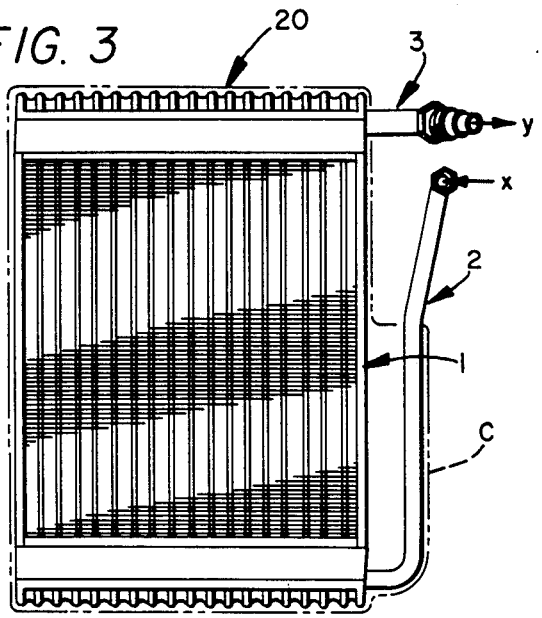
FIG. 2b
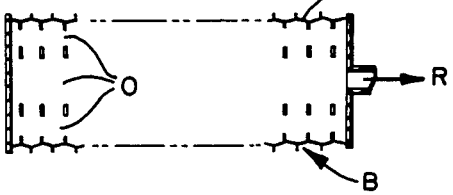

AIR CONDITIONER EVAPORATOR SYSTEM

COPENDING CASE

Some of the subject matter of this application is shown in my copending design patent application filed of even date herewith, which application is incorporated herein by reference.

BACKGROUND OF THE INVENTION AND PRIOR ART

This invention relates generally to evaporator systems, and more particularly to small compact systems, such as would be used in association with automotive air conditioners.

A typical example of this type of product in the prior art is seen in U.S. Pat. No. 4,244,194, issued to Hermann Haesters for Evaporator Particularly for Air Conditioning Devices, on Jan. 13, 1981. In this patent, a plurality of U-shaped tubes are attached to a distributor part by having their open ends bonded by a curable plastic in annular grooves in the distributor part. The applicant's use, in contrast, of expandable plastic, is between his exposed, but closed pipe ends and loops that extend beyond the horizontal fins at each end of his assembly for the purpose of preserving cooling capacity and preventing sweating, neither of which purposes would be accomplished by the substantial exposure of the U-shaped evaporator pipes 3 at the top of the patentee's FIG. 1.

Other examples of prior art evaporators are seen in the following U.S. patents:

U.S. Pat. No. 3,422,884 to P. S. Otten, for Condenser Tube Bundles, issued Jan. 21, 1969, discloses a technique for assembling and supporting condenser tube bundles wherein a foam plastic surrounds the ends of the condenser tubes and between spaced header plates and is used to hold the tubes in place without welding.

U.S. Pat. No. 3,633,660 to F. M. Young, for Plastic Bonding of Heat Exchanger Core Units to Header Plate, issued Jan. 11, 1972, shows the use of a plastic bonding substance at the upper ends of a plurality of heat exchanger tubes for the purpose of bonding the tubes to a dished header plate without the use of solder to reduce breakage due to vibration.

The U.S. Pat. No. 4,036,288 to R. Neveux, for Radiator for Air Conditioning System of an Automobile, issued July 19, 1977, uses a band of foam material to surround a stack of cooling fins supporting evaporator tubes in a manner to contribute to the lightness of the mounting of the radiator into an installational conduit.

U.S. Pat. No. 4,114,397 to R. Takehashi, et al, for Evaporator, issued Sept. 19, 1978, employs a tube plate to which upper ends of a plurality of U-tubes are fixed and wherein the lower ends of all tubes are U-shaped in a hairpin configuration. This patent does not teach the use of an expandable plastic foam material to both insulate the U-shaped ends and prevent condensation of water on their external surfaces.

The patent ot J-F Bouvot, U.S. Pat. No. 4,328,859 for Mounting for Heat Exchanger in Housing of Auto Air Conditioner, issued May 11, 1982, discloses a mounting technique that uses a belt of compressible foam material to accommodate varying tolerances in mounting dimensions and to minimize vibration effects after installation.

Also part of the prior art are the examples shown in applicant's FIGS. 1–2*b* in the drawing. FIG. 1 represents an example of the type of automotive air conditioner evaporator unit that is available for purchase by automotive repair shops and mechanics for installation in automobiles in the "after market", i.e., replacement parts in new or used automobiles that are no longer under factory warranty. FIG. 2 in contrast thereto, represents an example of the type of automotive air conditioner evaporator unit that is installed on new cars at the factory, and this type of product is known in the trade as O. E. M., which is the acronym for "Original Equipment Manufacture".

FIG. 1 shows the evaporator unit "A" installed within an automotive air conditioning cowling "C", but since the dimensions of A do not provide a precise fit, the open areas are filled with a packing material "P". In operation, the refrigerant "R" enters into fitting $f_1$ and travels through four reduced diameter ($\frac{1}{8}$" vs. $\frac{3}{8}$" in rest of cycle) tubes to enter each of four in-line circulation paths as seen more clearly in FIG. 1*a*. So in this unit, the refrigerant entering the evaporator unit from each input tube i travels the full longitudinal length of the evaporator with many U-turns before exiting through output manifold m and outlet fitting $f_2$. The cooling fins $F_1$ of this unit are oriented vertically because it was thought that condensation on the fins should flow downward to permit drainage from the bottom of cowling C.

FIG. 2 shows the evaporator unit "B" installed in the same cowling C as unit "A" was. This unit has the same air flow path as A, i.e., into the paper as viewing each drawing, but instead of long vertical fins, it has a greater number of small accordian like fins $F_2$, that extend horizontally between vertical extending tube sections T that provide for a plurality of very small diameter ($\frac{1}{8}$") formed tubes $t_1$ that open into the large cavity of horizontal end chambers E at the top and bottom of unit B. In this unit there is no precise circulatory path for refrigerant entering inlet fitting $f_3$ and exiting through outlet fitting $f_4$, since all of the refrigerant entering passes into the large cavity end chamber E at the bottom of unit B and travels upward (while expanding) through the large plurality of vertical tubes $t_1$ and exits into the top end chamber E and out through outlet fitting $f_4$. The large expansion chambers E at top and bottom of the Evaporator B are made up of a plurality of vertical sections with three large openings O in each section, so that the refrigerant flows from the five very small tubes $t_1$ into the very large open areas afforded by the chamber E. These large chambers E permit very rapid expansion of the refrigerant and this contributes to freeze up in the very small tubes $t_1$. Also there is substantial condensation on the outside of the top and bottom end chambers, which is undesirable and represents loss of cooling capacity and wasted energy. Further, the exterior of the top and bottom chambers E comprises very sharp edges which are difficult and dangerous to handle at installation of the evaporator into its cowling.

The applicant's product, as will be described in more detail hereafter, in contrast, comprises a specified number of well defined refrigerant travel paths through his unit 1, and his top and bottom areas are covered to prevent sharp edges, and to provide an attractive compact plastic housing that is contoured for strength and insulation holding purposes with no exposed sharp edges, either on his fins (as in the case with unit A of FIG. 1) or with the top or bottom exterior exposed (as in the case of unit B of FIG. 2). Further, his top and bottom exterior covers provide a receptability area to hold an expandable foamlike insulation which has the multiple purpose of insulating the normally exposed U-tubes in the refrigerant travel cycles, and of preventing "sweating" or moisture condensation at those locations. In summary, the applicant's evaporator is compact, attractive, less dangerous to handle, and more efficient in operation when compared to the prior art units.

SUMMARY OF THE INVENTION

One of the principal uses of this invention is to replace the automotive air conditioner evaporator system that was installed at the factory at the time the automobile was manufactured. The automobile manufacturer provides a semi-rigid composition or plastic shroud or cowling to enclose the evaporator, so that the conventional "after market" suppliers (vendors, usually independent of the auto manufacturer) must provide a product that will fit into the available space and comply with the available mounting requirements already present in the vehicle.

The instant invention meets the above requirements and also adds a special housing of its own to provide advantages not present in the O. E. M. product that was installed at the auto manufacturer's factory, and is not present in the product of the after market suppliers. The invention utilizes a plurality of generally copper tubes that are aligned vertically in parallel orientation, and extend through a multiplicity of closely spaced horizontally aligned parallel fins of generally aluminum material. The fins and their interconnecting aluminum sleeves cover the entire area of exposure of the tubes, and provide for rapid absorption of heat from the air flowing over the fins and by the sleeves and tubes. The U-shaped ends of the tubes as well as the manifold arrangement are all encased in an expanded plastic foam like material, which prevents loss of cooling capacity and prevents sweating in this area. Further, since the instant invention directs the flow of freon mist that enters the bottom manifold into five (5) separate individual paths through the evaporator, the freon moves through the evaporator in a very short time as compared with the serially oriented path pattern, the efficiency of heat transfer is greatly improved.

BRIEF DESCRIPTION OF THE DRAWING

FIG. 1 depicts an example of the prior art that is currently manufactured for installation on automobiles that comprise the "after market";

FIG. 1*a* is an end elevational view of the device of FIG. 1;

FIG. 2 is another example of the prior art of automotive air conditioner evaporators that are used by original equipment manufacturers (O.E.M.) for installation of new vehicles;

FIG. 2*a* is a cross section taken along lines 2*a*–2*a* of FIG. 2;

FIG. 2*b* is a cross section taken along lines 2*b*–2*b* of FIG. 2;

FIG. 3 is an outline view of the evaporator of the instant invention that is installationally interchangeable with the prior art products;

DESCRIPTION OF THE PREFERRED EMBODIMENT

Figure 4:
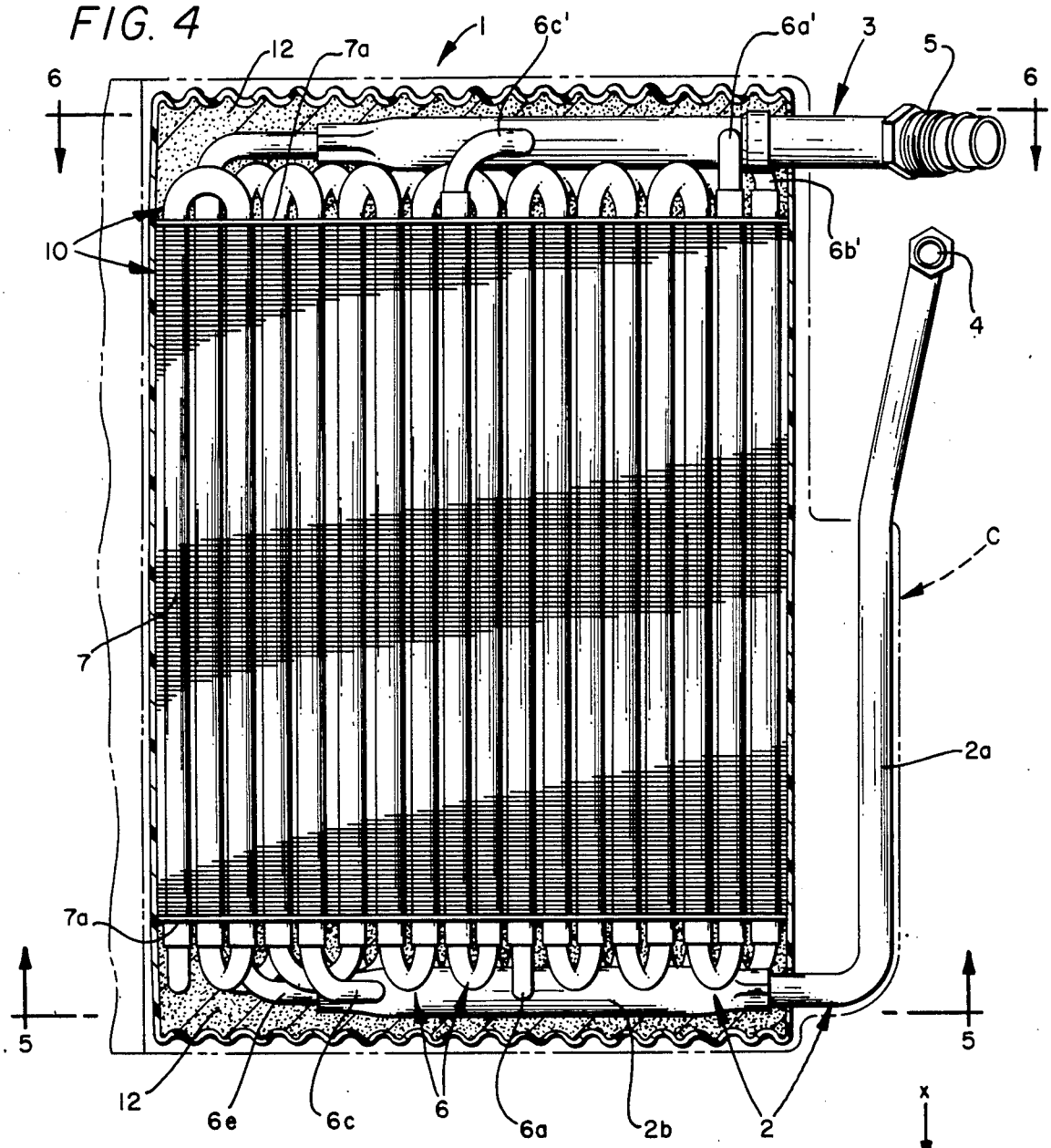
FIG. 4 is a front elevational view of the product of this invention, partly in section, and shown in its installation receptacle (shown in phantom outline) in an automobile.
Figure 5:
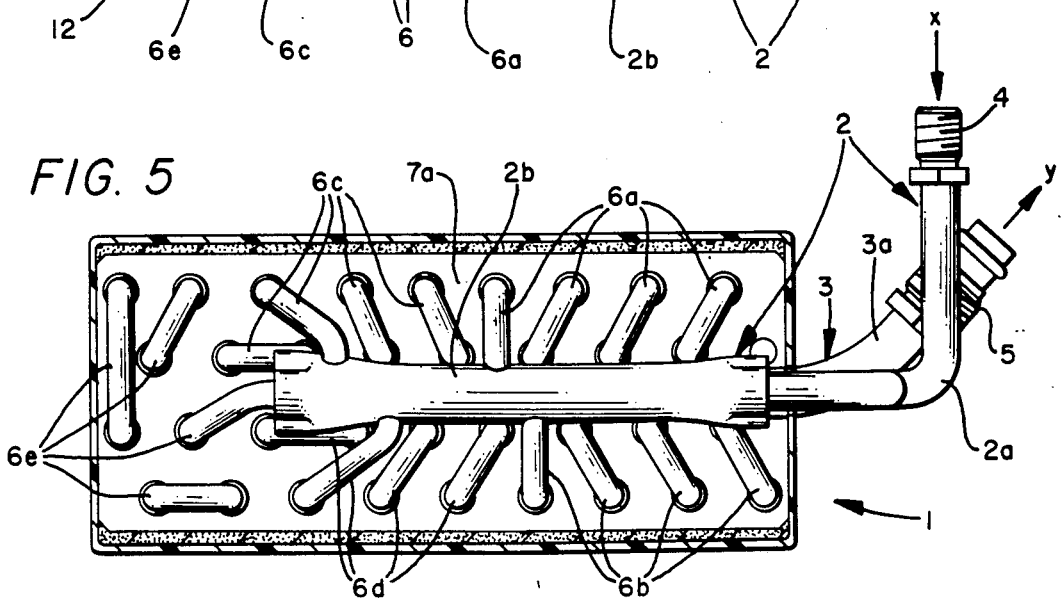
FIG. 5 is a bottom view, partly in section taken along the lines 5—5 of FIG. 4.
Figure 6:
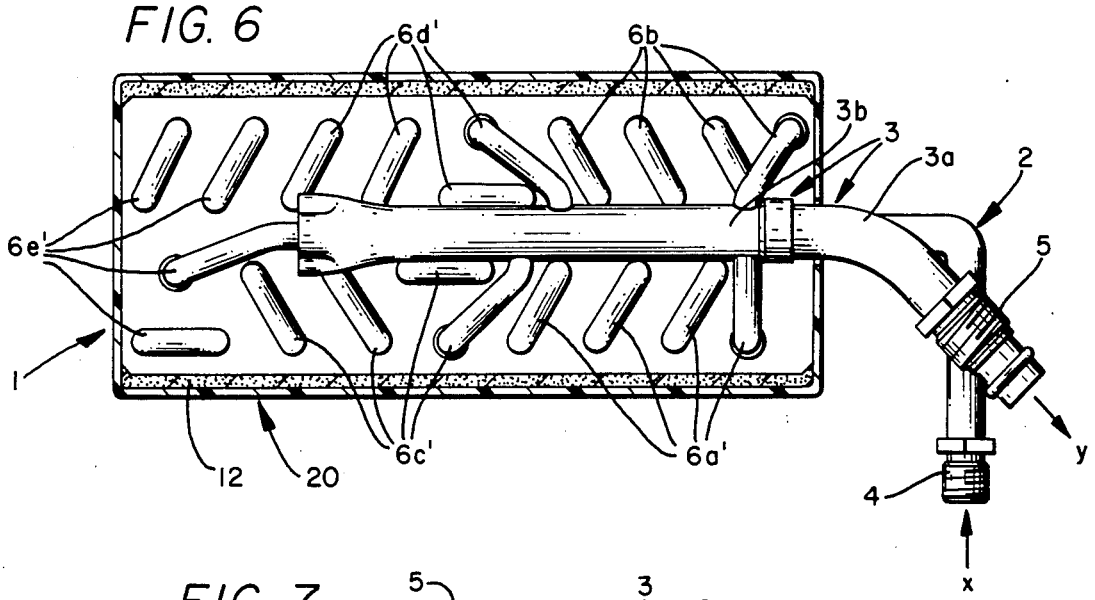
FIG. 6 is a top view, partly in section taken along the lines 6—6 of FIG. 4.
Figure 7:
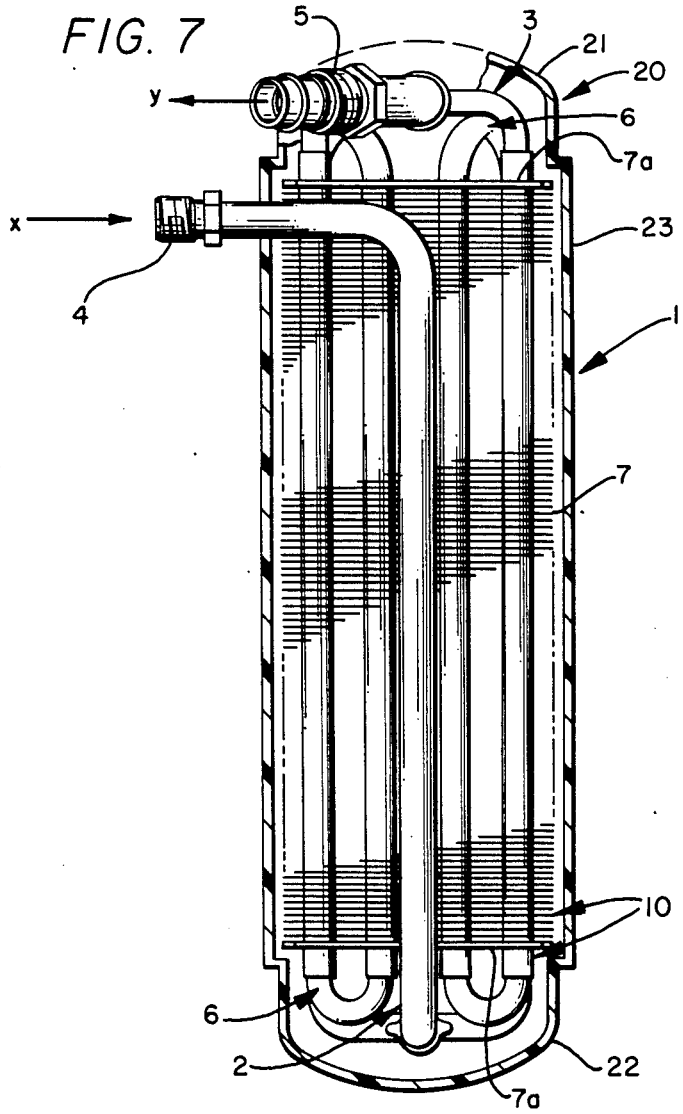
FIG. 7 is a right side elevational view with the near side housing cover removed.

The present invention, identified at 1 in FIGS. 3 and 4, utilizes a split distribution technique to deliver gaseous input refrigerant from its intake manifold system 2, shown more clearly in FIG. 5, and through tube system 6, and directs exhaust refrigerant gas to a return manifold system 3, shown particularly in FIG. 6. The arrows X and Y respectively of FIGS. 5 and 6 indicate this cycle.

Between the input line from the automotive air compressor (not shown) that delivers a liquid refrigerant and connects to fitting 4, and the exhaust line that returns the refrigerant gas from fitting 5 to the compressor for recompression and recycling as a liquid, there is an expansion valve (not shown) internal of line 2*a* and near fitting 4 for expansion of liquid freon into a mist and gas for travel through the several U-tubes 6 that, together with fins 7, make up the evaporator system. By the time the refrigerant reaches the return manifold system 3, it is substantially all in a gaseous phase, and ready for liquefying via the compressor, and for recycling.

A selective channeling is employed in intake manifold 2*b*, which divides and directs its refrigerant into five tube groups as seen in FIG. 5, and identified at 6*a*, 6*b*, 6*c*, 6*d*, and 6*e*, for circulation through the stack of parallel fins 7, and eventually to the return manifold 3*b*, as seen in FIG. 6, and identified at 6*a*′, 6*b*′, 6*c*′, 6*d*′, and 6*e*′, for transmission to the compressor via manifold system 3 and fitting 5, etc. Each of the tube groups forming the tube coil system 6 (which together with manifold systems 2 and 3 is the expansion chamber for the refrigerant) travels through a specifically selected circuit, such as seen by following the routes taken by tubes 6*a*–6*a*′, 6*b*–6*b*′, etc., which can be followed by reference to FIGS. 5, 6, and 11, et al. This technique of routing divides the tube system 6 into five separate tube circuits, identified as 6*a*–6*a*′, etc., wherein each tube circuit, starting with 6*a*, employs seven vertical tube paths through the horizontal fins complex to arrive at the exit tube 6*a*′. The circuituous tubes 6, fins 7, input 2*b* and exhaust 3*b* manifolds and input and exhaust tubing 2*a* and 3*a*, comprise the evaporator system 10. There are several advantages for splitting the tube coil system 6 into the several shorter length expansion chambers. If a single continuous tube coil system were employed, the freon gas would expand too rapidly and the temperature externally of the coils would be so cold that any condensed moisture on the tubes or fins would freeze up, as would any moisture elsewhere in the system. However, with five separate chambers, as in this invention, the expanding freon in each chamber may still attain a high velocity, but since it travels such a short distance, it will not reach a freezing temperature. Another advantage is that the high velocity encountered here is sufficient to return substantially all of the oil in the line back to the compressor, which is important to the longevity of the compressor.

The evaporator system 10 including the intake and exhaust manifold systems 2 and 3, is installed in an evaporator housing which comprises a top 21 and bottom 22 serrated cap, and a pair of straight end walls 23 to form the box-like structural enclosure 20 which is sealed onto the system 10 by the medium of an expandable foam 12 that seals tight against and adhers to all the parts it engages. This sealing material 12 is a commercial product known as "INSTAPAK" Expanding Foam obtained from Sealed Air Corporation. The end product here is identified as an automotive air conditioner evaporator package 1, which is adapted to precisely fit within the shroud or cowling C provided by the automobile manufacturer, as seen in FIG. 4.

The evaporator package 1 is both attractive in appearance, and easy and safe to handle by automotive mechanics, since it contains no external sharp edges, and has completely enclosed and sealed off all of the internal sharp edges that are inherent in this type of product. In addition to these structural advantages, this product has the functional advantages of providing sufficient cooling capacity without the normally attendant condensation and loss of cooling capacity at the U-turn area of the coils, and without this annoying (to the driver) freeze-up present in many automobiles.

Figure 8:
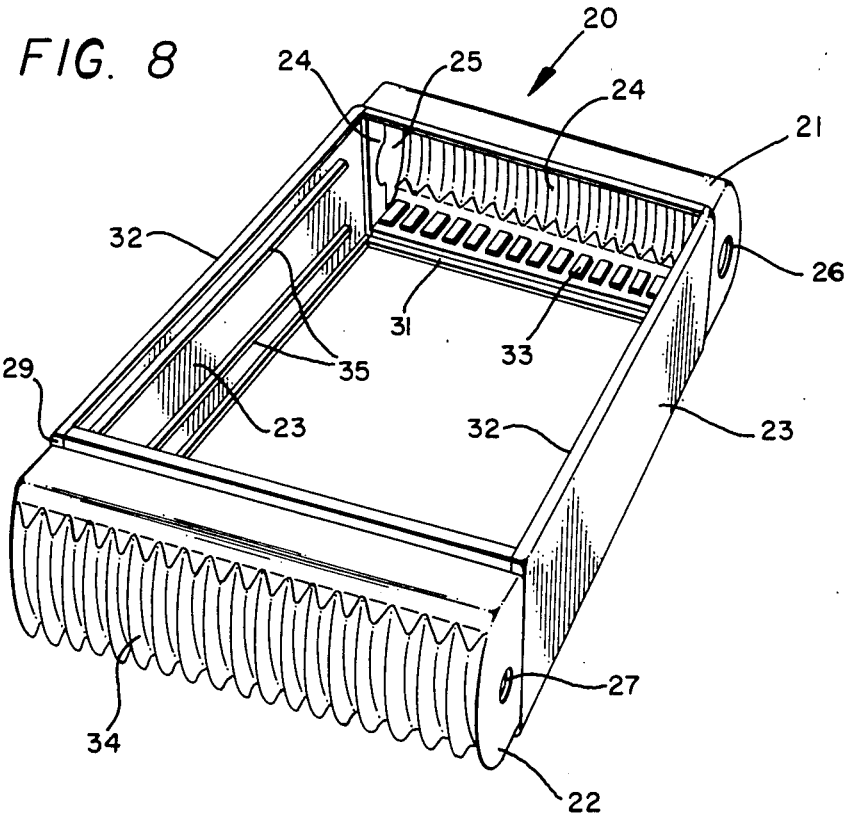
FIG. 8 is a perspective view of the housing cover separated from the evaporator per se and shown in a reclining position prior to its use.
Figure 9:
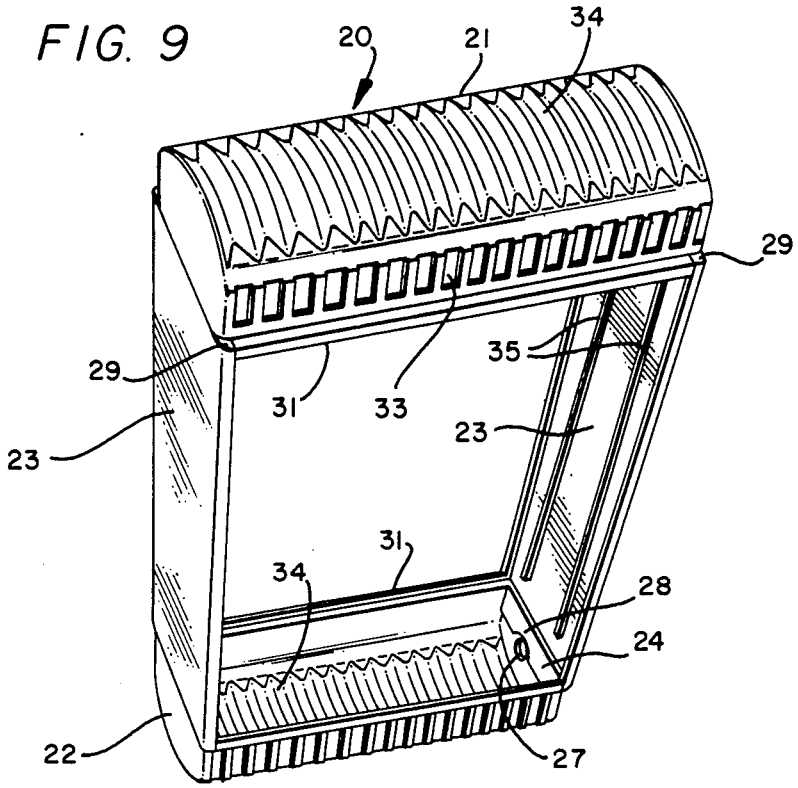
FIG. 9 is a perspective view similar to FIG. 8, wherein the housing is raised to a vertical position to show the cooperative structure required to encompass the evaporator at installation.
Figure 10:
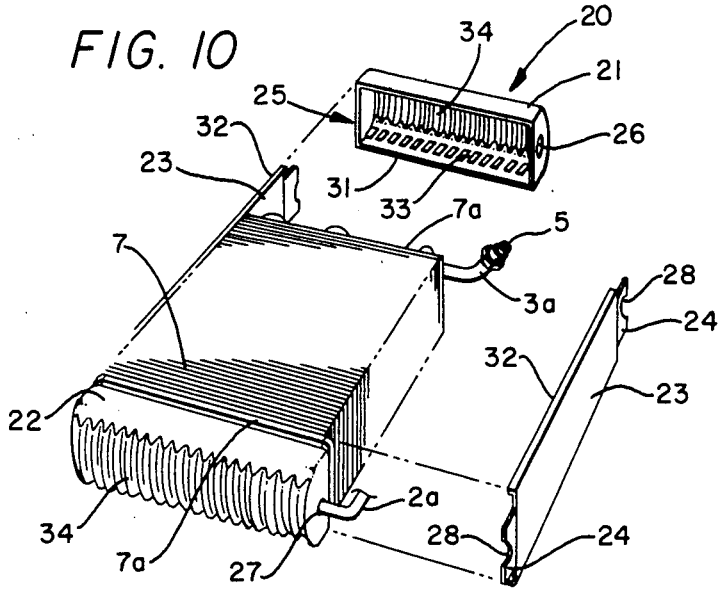
FIG. 10 is an elevational view similar to FIG. 4 showing the housing parts in exploded convention relative to the finished product.

FIGS. 8–10 show the plastic housing 20, that surrounds the evaporator system 10, to be comprised of a top and bottom cover cap, identified at 21 and 22 respectively, and a pair of vertical side walls 23, which are interchangeable, since each end tab 24 is of the same dimensions. These interconnect tabs 24 fit snugly into socket areas 25 that temporarily position the adjoining parts until a small amount of plastic glue (not shown) is applied to seal the parts together.

Figure 10A:
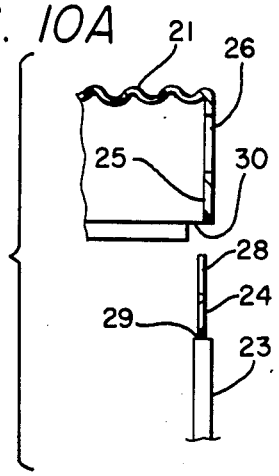
FIG. 10A is a detail cross sectional view of the housing corner connection of FIG. 10.

The top cover cap 21, when viewing FIG. 10 & 10A, has an opening in the form of hole 26 that slips over tubing 3*a* before fitting 5 is assembled. Similarly, cover cap 22 includes a smaller hole 27 to slip over tubing 2*a* (absent fitting 4). There is enough tolerance in the mating parts 21–27 to permit the sidewalls 23 to be inserted after the caps 21 & 22 have been installed over tubing 3*a* and 2*a*, and this is done just after the serrated interior of each cap has received a dab of expandable plastic foam material 12 from an ejector gun that lays down a thin line of such material, which material expands within a few seconds to both fill the interior cavity of caps 21/22 and to adhere to all the surfaces it comes int contact with, including tubes 6, manifolds 2*b* & 3*b*, etc. The person assembling the evaporator package 1 must, of course, act quickly to assemble and glue the parts 23 to each cap 21/22 before the foam material has expanded. FIG. 10A shows the corner details whereby the sidewall tab 24 with its curved recess 28 and the top ledge 29 abuts against the lower ridge 30 of cap 21, at which point the recess 28 is below the opening 26 so that no interference can occur with tubing 3*a*. The same is true re the lower tab 24 and its recess 28 and the tubing 2*a* in hole 27. The horizontal ledge 31 at the open end of each side of each cap 21/22, and ledge 32 on each vertical edge of sidewall 23 cooperate on assembly to completely enclose the sharp edges of the fins 7 and their upper and lower coverplates 7*a*. In fact, no sharp edges remain exposed in the entire evaporator package 1, once the assembly is completed. The ribs 33 and serrations 34 of each cap serve to both strengthen the plastic cap and provide a rough base to which the expandable foam 12 may more readily adhere. Ribs 35 also strengthen the sidewalls 23.

Figure 11A:
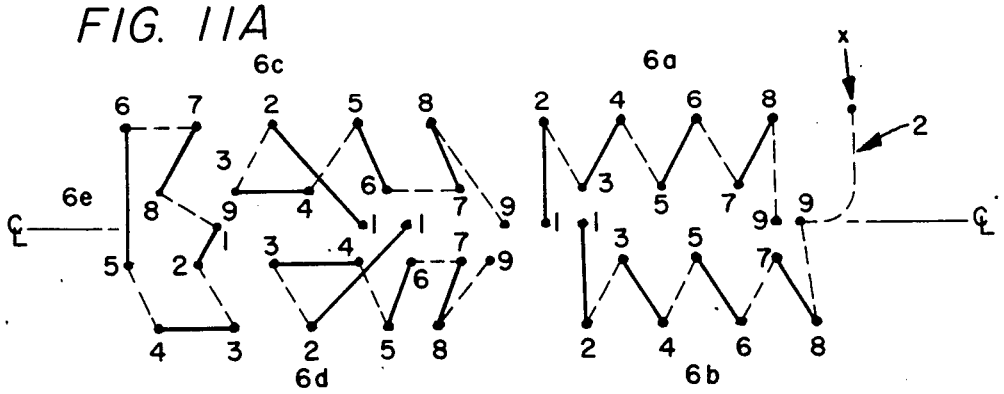
FIG. 11A is an outline drawing showing the various cyclical paths of the refrigerant passing through the evaporator in the orientation of FIG. 5.
Figure 11B:
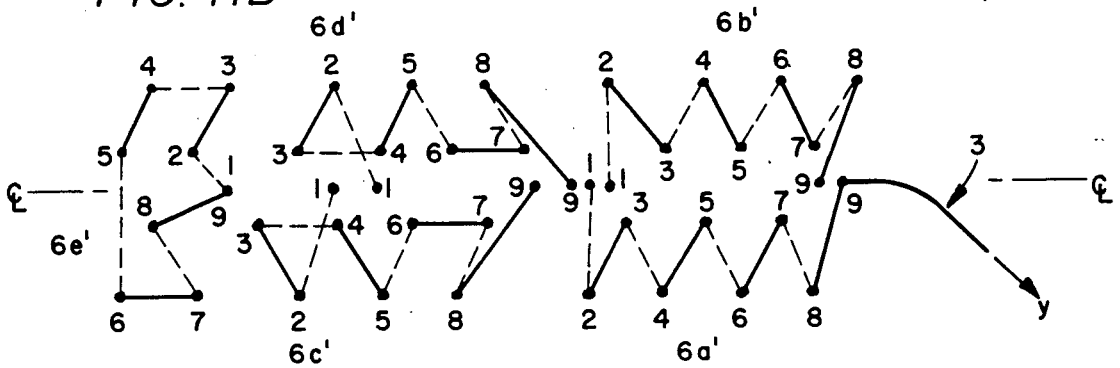
FIG. 11B is an outline drawing showing the various cyclical paths of the refrigerant passing through the evaporator in the orientation of FIG. 6

FIG. 11A shows the circuitry of the tubes 6*a*–6*e* when viewed from the same position at FIG. 5, and FIG. 11B shows the circuitry from the other end of the evaporator system 10, as would be the case when viewing FIG. 6. The incoming refrigerant X in FIG. 11A, enters from manifold system 2 and fans out into the expansion chamber comprising the manifolds and tube systems by exiting at tubes 6*a*–6*e*, and following seven vertical tube paths from each tube 6*a*, 6*b*, etc., until it enters the exhaust manifold system 3 of FIG. 11B thru tubes 6*a'*, 6*b'*, etc., and as exhaust refrigerant gas Y.

In FIGS. 11A and 11B, the liquid refrigerant, indicated by arrow X, entering manifold system 2, is transformed immediately through an expansion valve (not shown) into a misty gas which expands and flows through the tube system 6 and exits out of the manifold system 3 at fitting 5; however, between the entrance manifold 2 of FIG. 11A and the exit manifold 3 of FIG. 11B, the refrigerant takes a circuituous route involving five separate paths, for example, one path 6*a*–6*a'* starts in FIG. 11A with the path of (1) to (2) shown solid as seen leaving manifold 2 at about its midpoint and going into the fin cover plate 7*a* at (2), it then travels thru its U-shaped connector tube or hairpin turn, shown dotted in FIG. 11*a* from (2) to (3), then shown solid from (3) to (4), dotted from (4) to (5), etc., until it enters exhaust manifold system 3 at (9) and exits the tube system group 6*a*–6*a'* as indicated by arrow Y; the solid lines represent the tube sections visible in FIG. 5 and the dotted lines represent the sections not visible in FIG. 5, but visible in FIG. 6. The four other tube groups, 6*b*–6*b'*, etc., follow different but similarly circuituous paths to exit into and through manifold system 3.

That portion of each tube system that would normally be exposed to a non-beneficial environment, i.e., not within the cooling window of this evaporator system, is very heavily insulated when its area ia enclosed by housing cap 21 or 22, and the housing caps are filled with the referenced expandable foam adhesive plastic material 12.

By the above construction, loss of cooling capacity is greatly reduced, and "sweating" is virtually eliminated in the enclosed areas; further the tendency of this type of cooling system to freeze up is greatly reduced since each of the five paths present in shorter travel distance thru the tubes than each of the four paths of the prior art (FIG. 1), and since the applicant's tubes are large (⅜") they avoid the freezing propensity of the very small tubes (⅛"dia) of the other prior art (FIG. 2) products.

What is claimed is:

1. An evaporator package for air conditioners, comprising in combination:

a. a plurality of parallel air cooling fins substantially defining a heat transfer window, b. a tube system having a plurality of tubes that are parallel within said window and wherein certain, but not all, of said parallel tubes above and below said window are connected at the ends of said package, c. an intake manifold at one end of said package and connecting to selected ones only of said tubes at that end of said package, d. an exhaust manifold at the opposite end of said package and connecting to selected ones only of said tubes at that end of said package, e. said tubes, fins and manifolds comprise an evaporator unit, and wherein f. said manifolds and all said tubes connecting thereto being insulated at and near the joinder of said tubes and manifolds by an expandable foam material that simultaneously adheres to all of said tubes above and below said window, said manifolds and said package.

2. An evaporator package as in claim 1, comprising in combination an evaporator housing having separable easy to assemble top, bottom and side parts surrounding the top and bottom manifold ends, and the lateral sides only of said evaporator package.

3. An evaporator package as in claim 2, comprising an expandable foam plastic material between the inside of said top and bottom housing parts and the manifold ends of said evaporator package.

4. An evaporator package as in claim 2, wherein said fins comprise sharp corners and wherein said housing encloses all exposed tubes and manifolds and all exposed fin corners in said evaporator package.

5. An evaporator system for automobile air conditioners, wherein said automobile includes a cowling between the external air supply and the air conditioner, comprising:

a. an evaporator package installed in said cowling and including a plurality of parallel cooling fins and a plurality of parallel coolant tubes passing therethrough, b. U-shaped portions connecting certain of said tubes at a location external to said fins at each end of said evaporator package, c. an intake manifold at one end of said evaporator package and connecting certain of said tubes, d. an exhaust manifold at the other end of said evaporator package and connecting certain of said tubes, e. an evaporator housing, enclosing all of the exposed tubes and manifolds at each end of said package, and defining a cavity between the interior of the housing and said manifolds and tubes at each end of said housing, and f. an expanded foam material in said cavities and functioning to fill said cavities and provide insulation and prevent condensation within the cavities, wherein g. the expandable foam material insulates and adheres at and near the joinder of said tubes and manifolds.

6. An evaporator system as in claim 5, wherein a. said manifolds and tubes extend beyond each end of said cooling fins, b. said cooling fins comprise sharp corners, c. said housing encloses said manifolds and tubes and sharp edges and contains no sharp edges itself, and wherein d. said evaporator package with said housing attached are insertable into said cowling with no exposed manifolds and tubes and no exposed corners on said cooling fins.

* * * * *